US006322016B1

(12) United States Patent
Jacobsson et al.

(10) Patent No.: US 6,322,016 B1
(45) Date of Patent: Nov. 27, 2001

(54) THREAD DELIVERY DEVICE AND THREAD BRAKE

(75) Inventors: Kurt Arne Gunnar Jacobsson, Ulricehamn; Per Ohlson, Tvaerred, both of (SE)

(73) Assignee: IRO AB, Ulricehamn (SE)

( * ) Notice: Subject to any disclaimer, the term of this patent is extended or adjusted under 35 U.S.C. 154(b) by 0 days.

(21) Appl. No.: 09/380,026

(22) PCT Filed: Feb. 16, 1998

(86) PCT No.: PCT/EP98/00880

§ 371 Date: Nov. 15, 1999

§ 102(e) Date: Nov. 15, 1999

(87) PCT Pub. No.: WO98/38124

PCT Pub. Date: Sep. 3, 1998

(30) Foreign Application Priority Data

Feb. 24, 1997 (SE) ..... 9700666

(51) Int. Cl.[7] ..... B65H 51/20
(52) U.S. Cl. ..... 242/365.4; 139/452
(58) Field of Search ..... 242/365.4; 139/452

(56) References Cited

U.S. PATENT DOCUMENTS 3,926,381 12/1975 Lawson et al. .
4,068,807 * 1/1978 Jacobsson ..... 242/365.4
4,429,723 * 2/1984 Maroino ..... 139/452
5,343,899 * 9/1994 Jacobsson et al. ..... 139/452
5,409,043 * 4/1995 Zenoni et al. ..... 139/452
5,546,994 * 8/1996 Sarfati ..... 139/452
5,582,214 * 12/1996 Sarfati ..... 139/452
5,678,779 * 10/1997 Maina ..... 242/365.4
5,738,291 * 4/1998 Tholander ..... 242/365.4
5,778,943 * 7/1998 Tholander ..... 139/452
5,979,815 * 11/1999 Svanstroem et al. ..... 242/365.4
6,125,892 * 10/2000 Fritzson ..... 139/452

FOREIGN PATENT DOCUMENTS 534 263 A1 3/1993 (EP) .
59-143867 8/1984 (JP) .
WO94/20402 9/1994 (WO) .
WO95/00431 1/1995 (WO) .

* cited by examiner

*Primary Examiner*—Michael R. Mansen
(74) *Attorney, Agent, or Firm*—Flynn, Thiel, Boutell & Tanis, P.C.

(57) ABSTRACT

A yarn feeding device having a storage body defining a frontal withdrawal rim which forms a yarn braking zone of a yarn brake in co-operation with a circumferentially continuous braking band in the shape of a frustocone jacket and made of a material which is elastically deformable perpendicular to the generatrix of the frustocone. The yarn brake includes a stationary support for the braking band carrier which presses the braking band substantially axially and resiliently against the withdrawal rim. The braking band is held in a floating manner in relation to the withdrawal rim and in relation to the braking band carrier.

29 Claims, 5 Drawing Sheets

FIG. 1
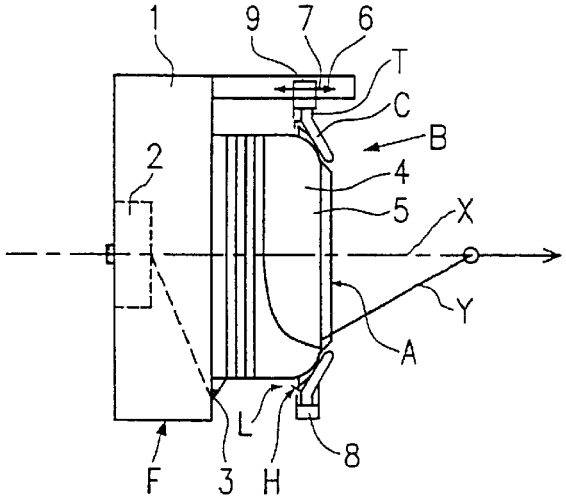
FIG. 2
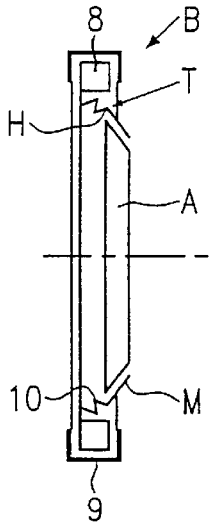
FIG. 3
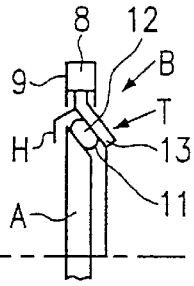
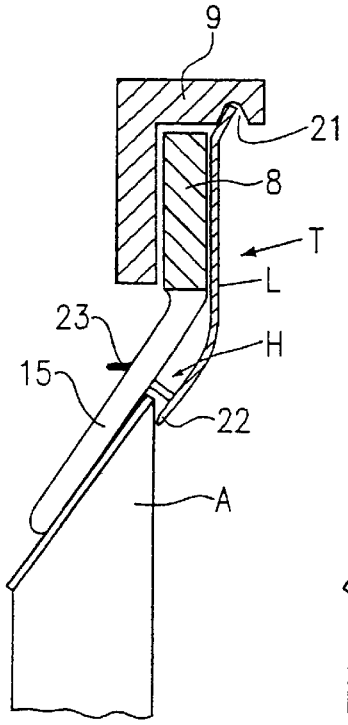
FIG. 6
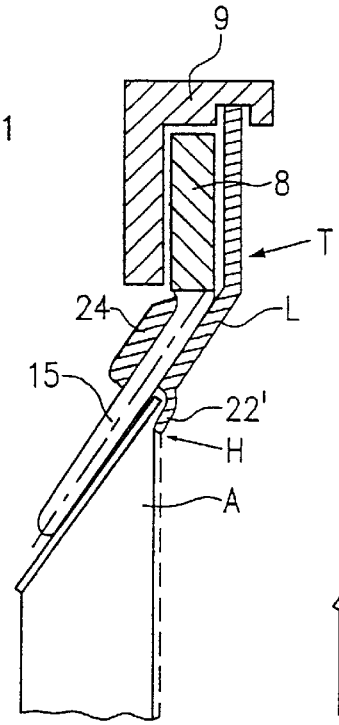
FIG. 7
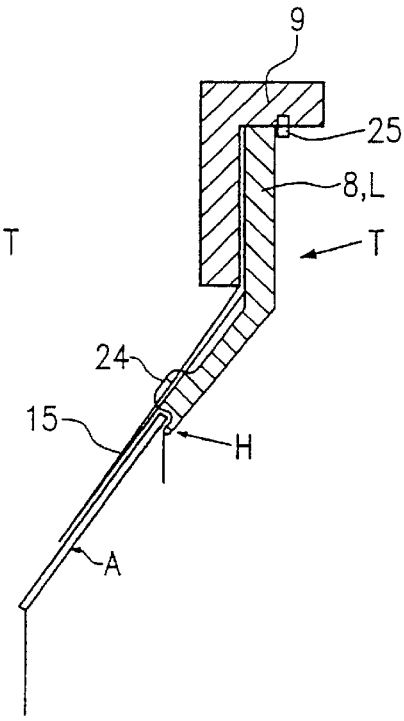
FIG. 8

FIG. 14
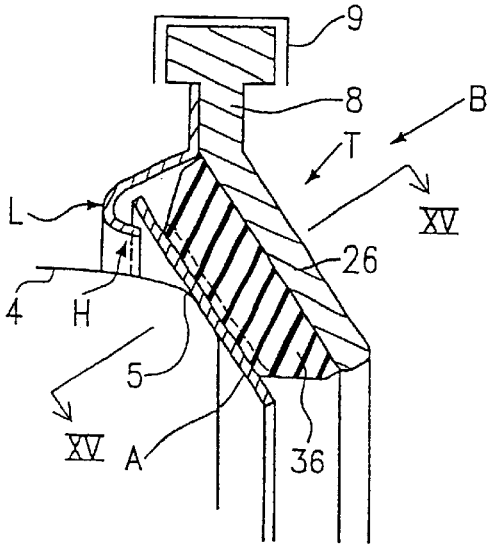
FIG. 15
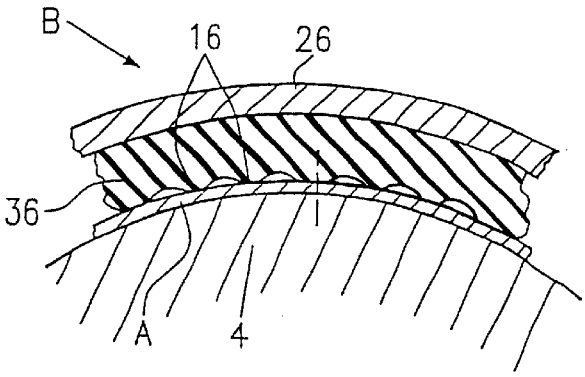
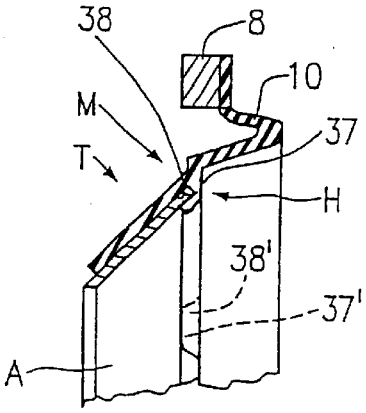
FIG. 16
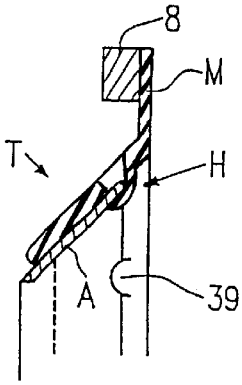
FIG. 17
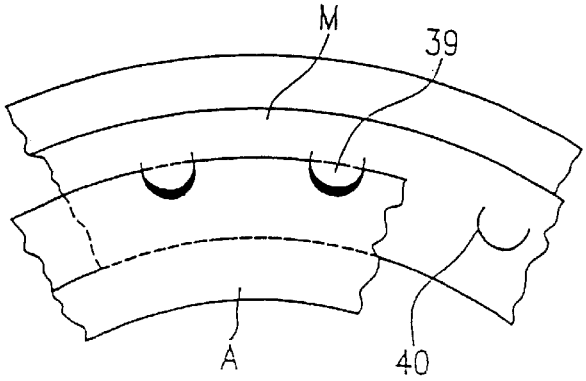
FIG. 18

THREAD DELIVERY DEVICE AND THREAD BRAKE

FIELD OF THE INVENTION

The invention relates to a yarn feeding device having a storage body with a withdrawal rim which cooperates with a braking band of a yarn brake to form a yarn braking zone. The invention also relates to a yarn brake for use in such a yarn feeding device.

BACKGROUND OF THE INVENTION

In a yarn brake on a yarn feeding device as known from PCT/EP 94/00476, the braking band is glued into the small diameter end portion of a generally conical rubber membrane circumscribing the storage body and being supported at its large diameter end in the stationary support to pull the braking band inner side against the withdrawal rim of the storage body. Such yarn brakes are extensively used at yarn feeding devices for projectile and rapier weaving machines. The membrane commonly constitutes the braking band carrier, and the spring element transmits the axial pressing force onto the braking band without disturbing the local radial deformability of the braking band. Even though it is intended to make the membrane as homogenous as possible nevertheless in operation of the yarn brake the pressing force of the braking band against the withdrawal rim may vary in the circumferential direction. This causes undesirable fluctuation of the withdrawal tension level of the yarn pulled through between the inner side of the braking band and the withdrawal rim and is simultaneously orbiting in the circumferential direction. Gluing the braking band to the braking band carrier is time-consuming and costly. The junction region creates an inhomogeneity which negatively influences a uniform distribution of the pressing force of the brake band along the braking zone. In addition, the friction of the yarn orbiting during withdrawal is transmitted by the braking band into the membrane, which generates a torsional tension in the membrane as the membrane is firmly secured in the large diameter end portion in the support. Said effect caused by the yarn may additionally complicate the uniformity of pressing the braking band against the withdrawal rim. The known yarn brake, however, fulfills a particularly desirable self-compensating effect since it automatically decreases its braking effect with increasing or high withdrawal speed of the yarn and an increase in the yarn tension or a high yarn tension level caused by said withdrawal speed, but the circumferentially varying pressing force of the braking band is disturbing, particularly in the case of sensitive yarn qualities and in modern high performance weaving machines operating with high insertion frequency and extreme insertion speed variations.

A self-regulating yarn brake having a radially deformable braking band with the shape of a frustocone for the first time has been disclosed in EP-A-0 534 263. Said braking band is firmly glued to the inner side of a frustoconical braking band carrier which is radially deformable but axially stiff and is axially loaded in the stationary support by means of a spring assembly. The gluing junction area between the braking band and the braking band carrier has to be made precisely and uniformly and may influence the uniform pressing force distribution of the braking band.

In order to replace the braking band in such yarn brakes having a durable, firm connection between the braking band and the braking band carrier, the braking band carrier has to be disassembled as well and has to be discarded.

It is an object of the invention to create a yarn feeding device of the kind as disclosed as well as a yarn brake for such a yarn feeding device wherein the important advantage of the self-compensating effect is maintained, a negative influencing of the yarn withdrawal tension level due to a circumferentially varying pressing force can be avoided, and wherein the yarn brake is easy to manufacture and handle.

This object can be achieved by supporting the braking band in a floating manner relative to the braking band carrier and the withdrawal rim.

Due to the holding of the braking band in a floating manner, a labour and cost intensive gluing connection between the braking band and the braking band carrier is avoided. In connection therewith the almost unavoidable inhomogeneity of a gluing connection in the force transmission is avoided. The braking band is pressed against the withdrawal rim circumferentially uniformly and regularly. The torsional force generated by the orbiting motion of the yarn and the friction contact of the yarn with the inner side of the braking band is not or not significantly transmitted into the braking band carrier such that the negative influence of such torsional force on the contact between the braking band and the withdrawal rim is avoided. The braking band may move in relation to the braking band carrier during operation and could even rotate. A floating holding of the braking band means a positive engagement which hinders losing the braking band in case of missed contact with the withdrawal rim. However, there is no structural connection between both components but only some sort of a loose trapping. This contributes to the uniformity of the contact pressure. In case that the braking has to be replaced, e.g. due to wear or for adaptation to particular yarn qualities, this can be made easily. The braking band carrier can be used longer and does not need to be disassembled. In order to provide an optimum self-centering of the braking band on the withdrawal rim it can be expedient to support the braking band carrier in a self-centering Cardanic fashion.

The yarn brake can be manufactured with fair costs and in a simple fashion; mounting and maintenance are easy to carry out. The pressing contact relationships between the braking band and the withdrawal rim are optimum thanks to the floating holding, since there is no structural connection between the braking band carrier and the braking band which causes a disturbance when transmitting the axial pre-load force.

The braking band is apt to position itself at least in tangential directions and relative to the normally rounded withdrawal rim, i.e. the braking band is apt to rotate about the axis of the storage body and to displace itself also in the direction of the generatrix of the frustocone or, respectively, to tilt in the braking zone without the necessity that the braking band carrier follow such movements or suppress such movements.

In contradiction to the conventional principle of a circumferentially uniform contact between the braking band carrier and the braking band, the advantage of the floating holding of the braking band is optimized. In the circumferential direction suspension ranges axially pressing against the braking band alternate with ranges not pressing or only pressing with reduced extent. Due to its elastic behaviour the braking is compensating for such differences in the pressing behaviour in an effective manner, particularly with higher yarn speeds. Occasionally the yarn may feel differences in the pressing force of the braking band in the braking zone with low yarn speed. However, this leads to the advantage of relatively high basic yarn tension in the yarn at low yarn speeds and under the axial pre-load of the braking band, which pre-load occasionally and nominally can be lower than in case of a full circumferential pressing relation. Thanks to the self-compensating effect fulfilled by the floating or suspended braking band the difference of the yarn tension between slow and highest yarn speeds remains desirably small, since the braking band does reduce the braking effect automatically with increasing yarn speed. Such a reduced axial pre-load nevertheless leads to a sufficiently high basic yarn tension and relieves the components of the yarn brake and improves the durability.

In one embodiment, the braking band carrier includes a plurality of circumferentially distributed suspension ranges separated by interspaces which contribute to a regular varying braking effect (digital plucking) and to a high basic yarn tension level already with moderate axial pre-load.

The suspension ranges may be formed resiliently in order to influence the local deformability of the braking band during the passage of the yarn circulating in circumferential direction as little as possible.

Further, the suspension ranges may be arranged at arms of the braking band carrier. Additionally or alternatively said arms may be resilient. This allows a gradual adjustment of the axial preload adapted to the initial operating conditions.

The dimensional extension of the braking band in the direction of the frustocone generatrix thereof is larger than the dimensional extension of each suspension range in the same direction, the dimensional extension of the suspension range in the above direction is larger than the width of the braking zone, and each suspension range extends substantially symmetrically beyond the extension of said braking zone. The braking band carrier thus actuates the braking band in the braking zone and even also in the neighbourhood thereof.

A braking band holding means is provided and grips outwardly and/or inwardly around at least one of the braking band edges with a clearance. The handling is improved since the braking band normally positioned by the axial contact pressure is prevented from being lost even when the axial pre-load force is relieved (e.g. for threading the yarn, during the mounting procedure or during the transport of the yarn brake). The holding of the braking band is intended to allow a comfortable mounting and also a quick replacement of the braking band and should only assure the necessary safety against loosing the braking band.

A properly controlled entrance of the yarn into the yarn brake is important for an optimum braking effect and for the self-compensating effect. In addition, it has to be assured in each rest period in-between insertion cycles that the yarn brought to a standstill will not be caught at the yarn brake. This object is solved by providing a yarn guiding element which also serves as an outer braking band holding means and which can be secured together with the braking band carrier in the support. Apparently, the yarn guiding element could also be suspended separately from the yarn brake. In such a case it can be preferable to additionally provide a braking band holding means at or in the braking band carrier.

In one embodiment, the braking band carrier at least in the axial direction has spring-like properties, and the axial pre-load of the braking band against the withdrawal rim is adjusted by the axial position of the support relative to the withdrawal rim.

The braking band carrier within the support or together with the support is axially loaded by an adjustable spring assembly. The axial pre-load of the braking band against the withdrawal rim can accordingly be adjusted very sensitively, e.g. when using a spring assembly having a relatively long operating stroke and advantageous spring characteristics.

The braking band is suspended inside of a frustocone jacket in a floating non-loosening fashion. The frustocone jacket forms the braking band carrier. Said frustocone jacket could be made, e.g. from plastics reinforced by carbon fibres and is axially stiff, radially deformable and lightweight.

A wearing element, e.g. with the shape of a frustocone jacket, is inserted between the braking band and the braking band carrier. Said wearing element does influence the local deformability of the braking band as little as possible but is distributing or minimizing wear between the braking band and the braking band carrier. Said wearing element could be made from easy gliding material in order to minimize the motion or float resistance of the braking band relative to the braking band carrier.

The arms of the braking band carrier are inwardly protruding spokes, spring lamellas or pins which are provided at an annular base body in radial planes about the axis. Equal pressing forces are achieved in the circumferentially spaced apart suspension ranges. The spring behaviour can be optimally predetermined by the design of the arms and their material choice. The braking band carrier is lightweight and is characterized by low mass, particularly in the contact region with the braking band. With the arms situated essentially in radial planes about the axis of the storage drum, offset reaction forces of the arms are avoided when the braking band is deformed.

Alternatively, said arms can be oriented obliquely in relation to radiuses on the axis, e.g. in order to increase the useable a arm length or to reduce the interspaces between the suspension ranges or to achieve in the circumferential direction an overlap or superimposing between the discrete suspension ranges.

The braking band carrier can be embodied by a circumferentially continuous ring which carries a circular spiral spring, the spring windings of which define the suspension ranges. The axial pre-load from the circular spiral spring is transmitted onto the braking band. Within very little space many uniformly acting suspension ranges are achieved.

The spring windings are obliquely angled in relation to the spring axis, and a soft response behaviour in said suspension ranges is achieved by the oblique orientation of the spring windings.

Elastically deformable braking band carrier variants are provided, such as a frustoconical annular membrane having at least one concentric undulation, a deformable ring chamber containing a fluid filling, or a resilient ring body made from elastic material such as rubber or foam, wherein thanks to the floating holding disturbing gluing junctions are avoided which contributes to the circumferential uniformity of the contact pressure. By means of said braking band carrier variants the axial pre-load can be adjusted very sensitively and gradually and compact yarn brakes can be achieved.

The braking band carrier transmits the axial pre-load either via a suspension zone which is circumferentially continuous and smooth or via a suspension zone which has separated hills and valleys. In each case the braking band is held floatingly.

The braking band is held in a pre-shaped pocket or within a plurality of circumferentially distributed pockets formed in the braking band carrier such that it cannot be lost. The pocket or pockets are pre-shaped in the braking band carrier, e.g. an elastic annular membrane made of polyurethane. This design is structurally simple and allows a simple mounting. The braking band and the braking band carrier are apt to move in relation to each other in case of forces caused by the operation. In each case a safe force transmission from the braking band carrier into the brake band and vice versa is assured.

Alternatively, several ears defined by slots in the braking band carrier hold the braking band. The outer edge of the braking band is inserted below said ears. Advantageously a simple tool similar to the horn of an anvil is used for mounting the braking band in the two last mentioned embodiments of the braking band holding. Said tool allows an easy opening of the pocket or the pockets to introduce the outer edge of the braking band.

BRIEF DESCRIPTION OF THE DRAWINGS

Embodiments of the invention will be explained with reference to the drawings, in which:

FIG. 1 is a schematic side view, partially as a sectional view, of a yarn feeding device equipped with a yarn brake, FIG. 2 is a detail view of a variant of the yarn brake of FIG. 1, FIG. 3 is a detail view of a further variant of the yarn brake of FIG. 1, FIG. 6 is a detail view of an additional variant shown in enlarged longitudinal cross-section, FIG. 7 is a detail view of a further variant shown in enlarged longitudinal cross-section, FIG. 8 is a detail view of a further variant shown in enlarged longitudinal cross-section, FIG. 14 is a further embodiment shown in longitudinal cross section, FIG. 15 is a sectional view in the plane XV—XV of FIG. 14, and also shows a further detailed variant, FIG. 16 is an enlarged cross section of a further embodiment, FIG. 17 is an enlarged cross section of a further embodiment, and FIG. 18 is a partial view in the axial direction of FIG. 17.

DETAILED DESCRIPTION

Figure 4:
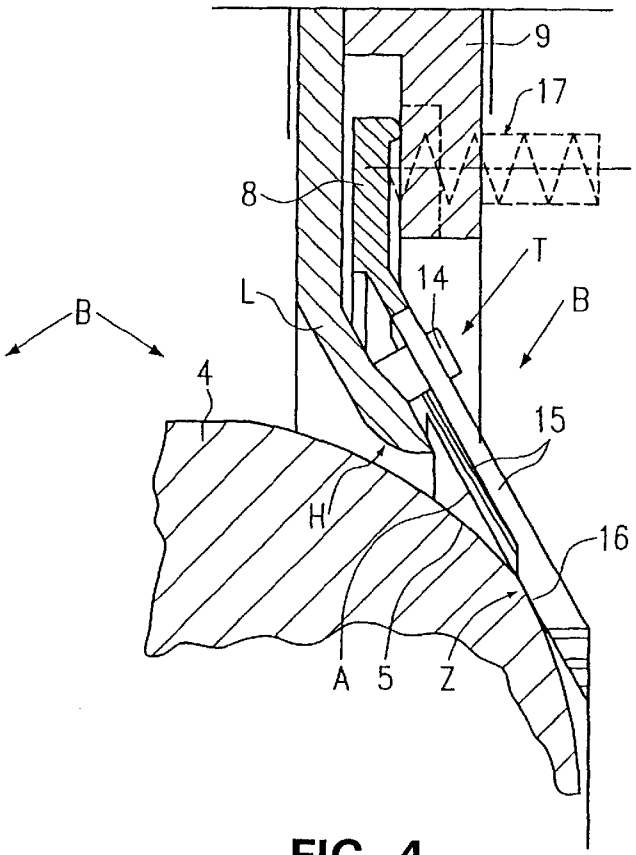
FIG. 4 is an enlarged longitudinal section of a further embodiment.

A yarn feeding device F equipped with a yarn brake B which occasionally can constitute its own structural unit, comprises a drive motor 2 for a winding-on element 3 and a housing 1. A drum-shaped storage body 4 is provided on housing 1. Storage body 4 has a circumferentially continuous, rounded or conical withdrawal rim 5. The yarn brake B is stationarily supported by a holder 9 which preferably can be adjusted in the direction of a double arrow 6 in the axial direction in a housing bracket 7. A substantially annular braking band carrier T is supported in holder 9 which braking band carrier T is pressing a circumferentially continuous braking band A essentially in the axial direction (axis X of the storage body) against withdrawal rim 5. The braking band is made from wear resistant material, e.g. from a metal or a metal alloy, with a thickness between 0.01 and 1.0 mm, and has the shape of a frustocone jacket. The braking band A is resiliently deformable at least in directions perpendicular to the frustocone generatrices, and moreover, is tension resistant. In FIG. 1 it is indicated that the braking band carrier is pressing the braking band A against the withdrawal rim 5 by means of circumferentially separated freely ending arms C. In the shown embodiment the storage body 4 is stationary. Alternatively the yarn feeding device F could have a storage body 4 which is rotatable about axis X. In the latter case it has to be assured that also the yarn brake B, at least the braking band carrier T can rotate as well. Occasionally there then might be provided a rotational drive for the braking band carrier T.

The yarn feeding device F according to FIG. 1 is mainly used for rapier or projectile weaving machines operating with intermittent weft yarn withdrawal. The yarn Y is introduced from the left side and is laid down on the storage body 4 in adjacent windings by means of winding on element 3. The yarn is withdrawn from between the braking band A and the withdrawal rim 5 and further in the direction of axis X from the last winding in the withdrawal direction. During withdrawal the running yarn is orbiting about withdrawal rim 5. The withdrawal angle of the yarn Y around the withdrawal rim 5 corresponds maximally to the cone angle of the frustocone of the braking band A.

The braking band A is floatingly suspended by the withdrawal rim 5 and in braking band carrier T or at its arms C, respectively. A braking band holding means H, which can consist of discreet, circumferentially distributed holding elements, prevents the braking band A from falling in the event that the yarn brake B is lifted from the withdrawal rim 5 or while the braking band A is mounted. Advantageously said braking band holding means H also is designed as an annular yarn guiding element L controlling the entrance of the yarn into the yarn brake B and influencing or limiting the formation of a yarn balloon.

In the yarn brake B according to FIG. 2 the braking band carrier T is a generally conical annular membrane M made from rubber or elastomeric material (e.g. polyurethane) with the shape of an annular ring, preferably having concentric undulations 10 and an outer form-stable ring 8 supported in holder 9 as shown in FIG. 1. The braking band A is carried in the braking band carrier T and is prevented from falling by a braking band holding means H.

In the embodiment as shown in FIG. 3 the braking band carrier T is defined by an annular chamber 11, preferably a hollow ring chamber 11, with a fluid filling 12. Said ring chamber 11 consists of elastic material and is arranged within a conical supporting body 13 which is firmly secured in ring 8 and is supported together with ring 8 in holder 9. The braking band A is provided floatingly in braking band carrier T and is secured against falling out by braking band holding means H. In FIGS. 2 and 3 the braking band carrier T is contacting braking band A in a circumferentially continuous fashion.

Figure 5:
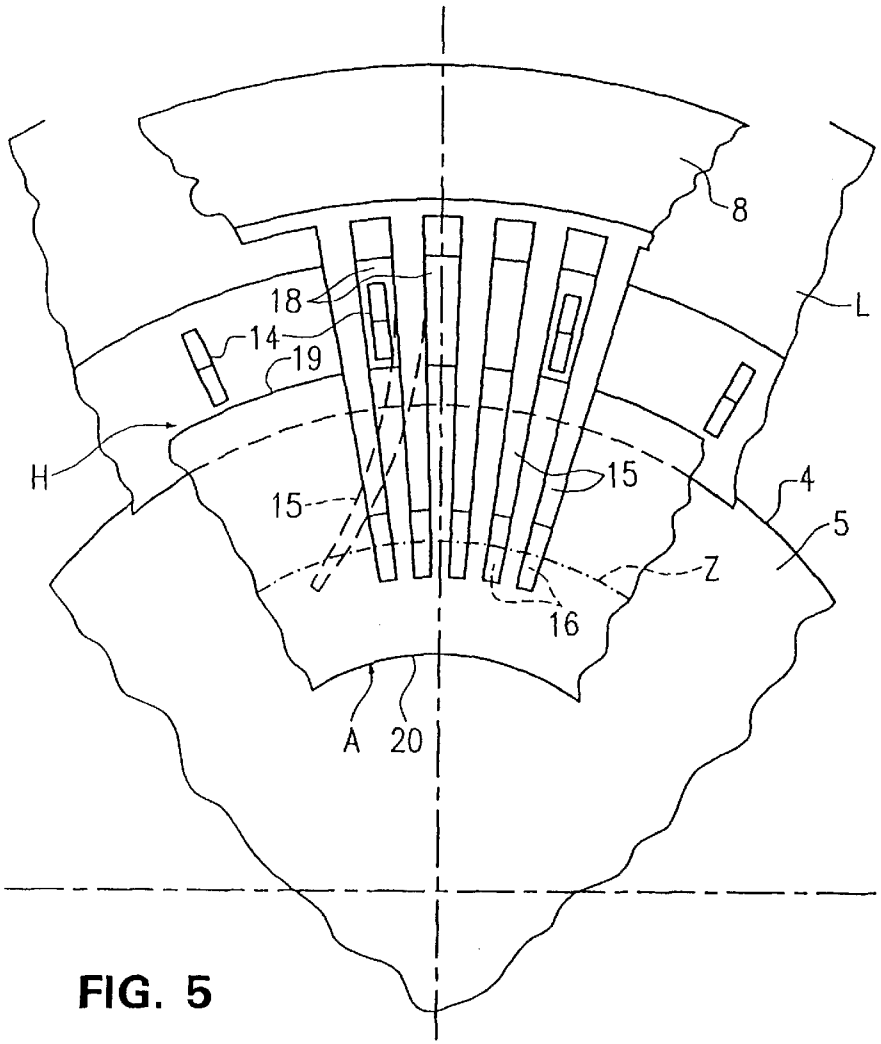
FIG. 5 is a right side view of the embodiment of FIG. 4.

FIGS. 4 and 5 represent details of the yarn brake B of FIG. 1. The braking band carrier T is secured with its ring 8 in holder 9 and has arms, spokes, lamellas or pins 15 which are separated from one another in the circumferential direction by interspaces 18 and terminate at inner free ends. Each arm 15 is made resiliently and has a suspension range 16 which is at the rear side of braking band A and is coarsely aligned with a braking zone Z formed between the inner side of the braking band A and the withdrawal rim 5. In the circumferential direction and in the direction of its frustocone generatrix, the braking band A is held floatingly within braking band carrier T, e.g. with a motion clearance. The yarn guiding element L which can be fixed in holder 9, is defining an entrance gap for the yarn and is constituting here by its inner edge region said braking band holding means H. In addition protrusions 14 could engage within the interspaces 18 and could complete the braking band holding means. The braking band carrier T can be made from plastic material and/or metal, e.g. from spring metal sheet with single cut-out tongues. The axial pre-load transmitted by the braking band carrier T onto the braking band A is adjustable thanks to the spring behaviour of the arms 15 and by the axial position of holder 9. Alternatively it is possible (indicated in dotted lines) to provide a spring assembly 17 with a long spring stroke which actuates ring 8 in holder 9 and allows a sensitive adjustment of the axial pressing force for the braking band A.

In FIGS. 4 and 5 the braking band holding means H is co-operating with the outer edge 19 of the braking band A. Alternatively or additionally it would be possible to have braking band holding means (not shown) co-operating with the inner edge 20 of braking band A. It is expedient to define said suspension ranges 16 by drops of an elastic or even hard material (synthetic resin) applied to the tips of said arms or spring lamellas 15. Said suspension ranges either are even or slightly curved. In the circumferential direction said suspension ranges 16 can be designed with a concave curvature to fit to the frustocone jacket of the braking band A.

In FIG. 6 arms 15 are formed at ring 8. They consist of metal and/or plastic material. They are arranged obliquely so that they define a somewhat bigger cone apex angle than the cone apex angle of the frustocone of the braking band A. Said annular yarn guiding element L can be a sheet metal or plastic part having small wall thickness being secured by its outer edge in a groove 21 of holder 9 such that it simultaneously contributes to secure ring 8. An inwardly protruding end 22 of yarn guiding element L is forming the braking band holding means H with tongues 23 engaging in-between said arms.

In FIG. 7 said yarn guiding element L is designed at 24 as an additional supporting body for the arms, spokes, fingers or spring lamellas 15 of the braking band carrier T which is secured in holder 9 by means of the yarn guiding element L. An inwardly protruding edge portion 22' circumscribes the outer edge of the braking band A and forms the braking band holding means H such that the braking band A cannot be lost but nevertheless is provided in a removable fashion on braking band carrier T.

In FIG. 8 a sheet metal or plastic material form part having discreet arms 15 is secured in holder 9 by means of yarn guiding element L defining said ring 8, e.g. by means of a securing element 25. Portion 24 of yarn guiding element L additionally is supporting the arms 15 with a distance inside holder 9. The inner edge of the yarn guiding element L is forming the braking band holding means H for the floatingly supported braking band A.

Figure 9:
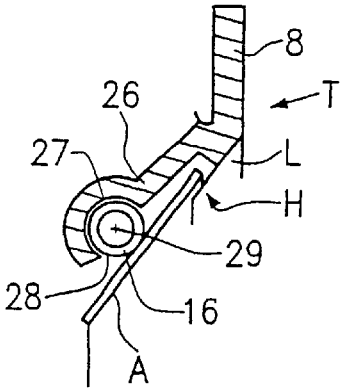
FIG. 9 is a detail view of a further variant shown in enlarged longitudinal cross-section.
Figure 10:
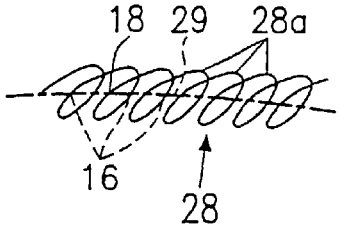
FIG. 10 is a detailed view in the axial direction of the embodiments of FIGS. 9 and 11.
Figure 11:
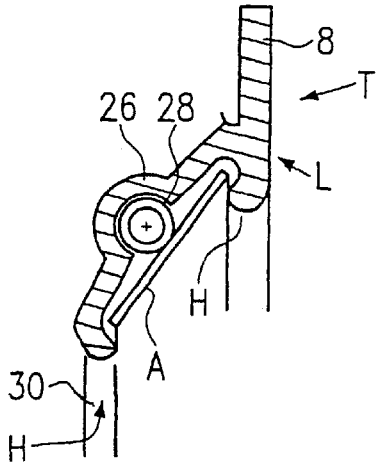
FIG. 11 is a detail view of a further variant shown in enlarged longitudinal cross-section.

In FIGS. 9 and 11 a cone-shaped supporting body 26 of the braking band carrier T is formed at ring 8. Said supporting body 26 can be made rigid and can carry in a receiving counterfort or groove 27 a circular annular spiral spring 28, the spring windings 28*a* of which (FIG. 10) define discreet suspension ranges 16 by which the braking band A is carried. Advantageously the spring windings 28*a* of spiral spring 28 are oriented obliquely in relation to the axis 29 of said spring in order to achieve a softer spring behaviour in suspension ranges 16. The braking band carrier T commonly forms the yarn guiding element L and the braking band holding means H. In FIG. 11 the inner edge of the braking band A is gripped with a motion clearance by the supporting body 26. The circular spiral spring 28 serves to transmit the forces. An inner thickened portion or bead 30 serves as an additional braking band holding means H. Preferably said portion 30 is made wearproof by plasma coating or in another fashion in order to prevent wear due to yarn contact. Spiral spring 28 is positioned by holding means (not shown) in its receiving counterfort 27.

Figure 12:
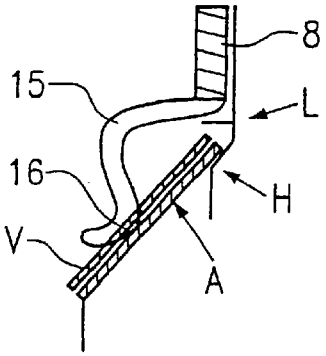
FIG. 12 is a further detail view of a variant shown in enlarged longitudinal cross section.

In FIG. 12 arms 15 at ring 8 are bent into an S-shape in order to achieve an increased spring length such that they generate forces in suspension ranges 16 substantially perpendicular to withdrawal rim 5. Further provided are the yarn guiding element L and the braking band holding means H. Additionally it is indicated in FIG. 12 that the braking band A does not directly contact the suspension ranges 16 but that an advantageously frustoconical wearing element V is inserted between arms 15 and braking band A which can be made with good gliding properties at least on one side or is directly made from a material which is wearproof and glides well. It is possible to secure said wearing element V by means of the braking band holding means H or to let it grip around the outer edge and/or inner edge of the braking band A.

Figure 13:
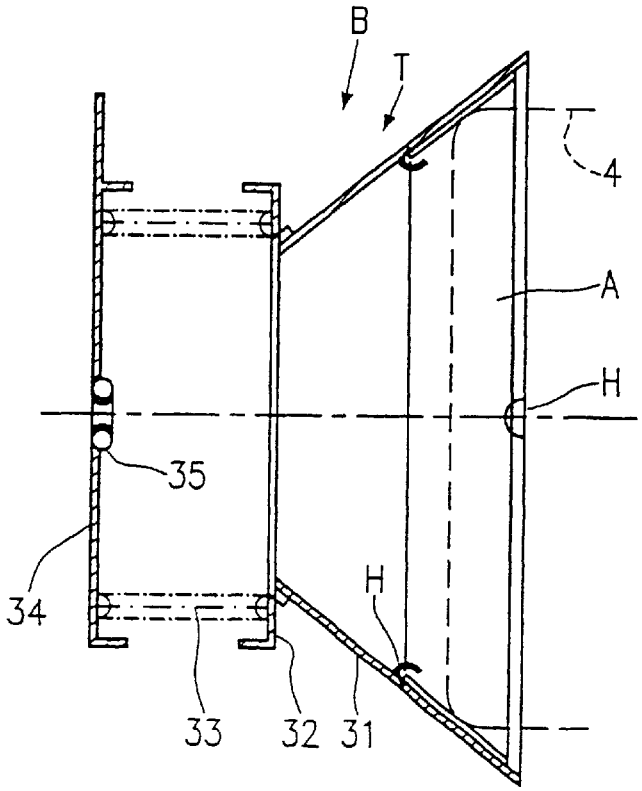
FIG. 13 is a further embodiment of a yarn brake shown in longitudinal cross section.

In FIG. 13 the braking band carrier T of the yarn brake B is a frustocone jacket 31 made from a material giving the frustocone jacket 31 significant rigidity in the axial direction but leaves it easily deformable in the radial direction. The braking band A is floatingly suspended inside frustocone jacket 31; optionally single braking band holding means H (noses, ears or lips) are provided in order to restrict the penetration depth of the braking band A into the frustocone jacket 31 and/or to prevent band A from falling. At its small diameter end the frustocone jacket 31 is connected with a supporting ring 32 which is axially resiliently supported via a spring means 33 in a stationary support 34 provided with a central withdrawal eyelet. Said spring means 33 preferably is adjustable in order to adjust the axial pre-load of the braking band A against the withdrawal rim 5 of the storage body 4. A useful material for frustocone jacket 31 is a thin plastic fabric reinforced by carbon fibres. In this case a guiding element L (not shown) could be provided at the housing bracket 7 of the yarn feeding device F (shown in FIG. 13) separated from the yarn brake B.

In FIG. 14 the braking band carrier T of the yarn brake B is a frustoconical ring body 8, 26 supported in holder 9 and a conical ring 36 consisting of soft elastomer or rubber or foam material. The ring 36 is secured at ring body 26 for pressing the floatingly supported braking band A against withdrawal rim 5. Moreover, the yarn guiding element L with the braking band holding means H can be provided at braking band carrier T in order to ensure that the braking band A cannot fall out.

Figure 15A:
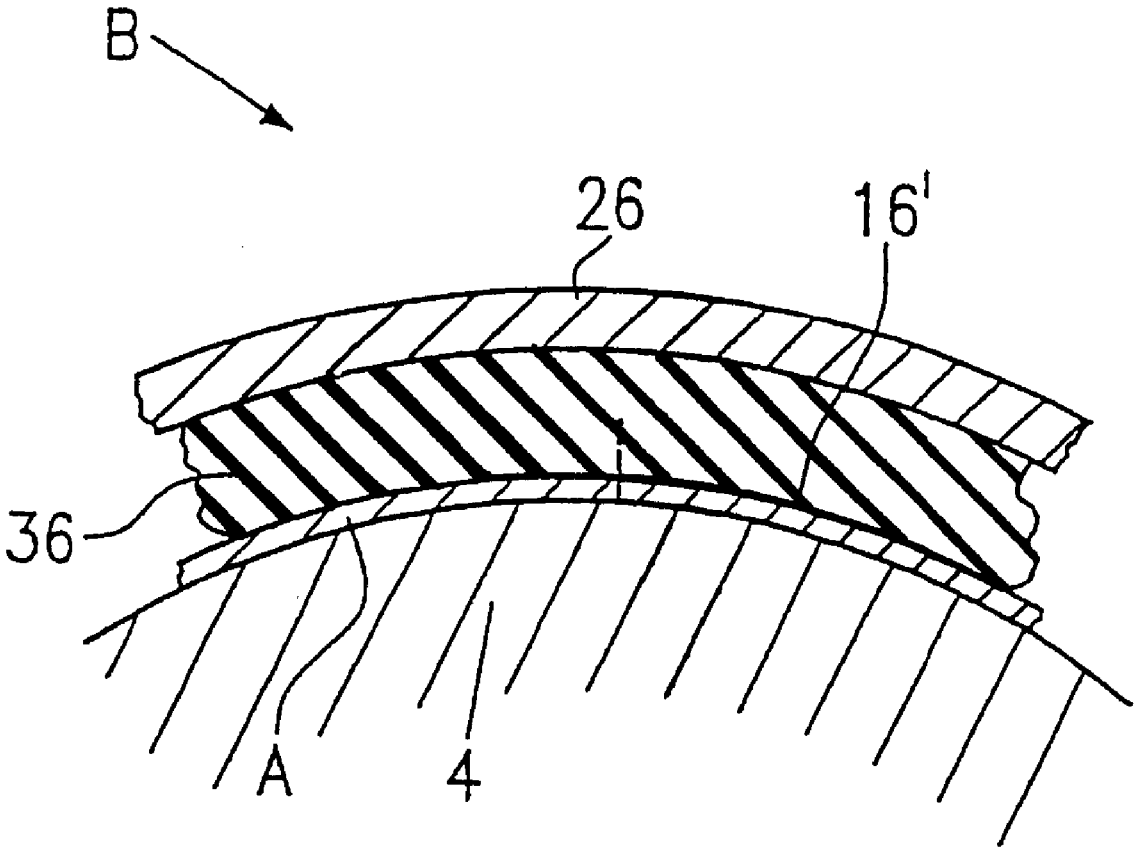
FIG. 15A is a further sectional view similar to FIG. 15 of an additional variant.

FIG. 15 shows a part of the yarn brake B of FIG. 14 in a section in the plane XV—XV. The resilient ring 36 is actuating the braking band A either by hills or undulations defining discreet suspension ranges 16, between which recesses are provided, or with a suspension range 16' which is circumferentially continuous and smooth (FIG. 15A).

During operation of the yarn feeding device, i.e. during withdrawal and braking of the yarn Y, the floatingly suspended braking band A can secure itself in relation to the braking band carrier T in an optimal position resulting from the force equilibrium between the axial pressing force and the counter pressure and the shape of the withdrawal rim 5. In the contact area between the braking band carrier T and the braking band A or at the suspension ranges 16, 16', respectively, the braking band A can move in the direction of the generatrix of the frustocone as well as in the circumferential direction. When the yarn Y is withdrawn such that the withdrawal point of the yarn is rotating around the withdrawal rim 5, the braking band A even might fulfill a rotational movement about axis X, at least in case of higher yarn speeds and so that the contact pressure of the braking band against the withdrawal rim remains uniform in the circumferential direction and so that a desirable wear distribution occurs. Thanks to the rotation of the braking band which is slower than the speed of yarn rotation, the braking band is contributing to a reduction of the yarn withdrawal tension level, i.e. is improving the self-compensation effect, since the relative speed between the yarn withdrawal point and the braking band is smaller than the relative speed between the withdrawal point and the braking band carrier T.

The braking band carrier can consist of spring steel, plastic material, zinc pressure cast or another material which allows the arms to be resilient. The tips of the arms should not be bent when transmitting the axial pressing force. This can be achieved by convexly curved suspension ranges or applied drops of synthetic resin. Particularly useful are steel lamellas as the arms actuating the braking band. Said steel lamellas can taper towards the tips in order to achieve a soft tip portion. Expediently, the braking band carrier is suspended in the stationary support by means of a Cardanic holding such that also the braking band carrier contributes to the centering. Even with easy manufacturable plastic or steel embodiments of the braking band carrier, yarn tensions up to 30 grams can be adjusted and maintained without problems. The usual operation range of such yarn brakes includes tension values between about 10 and 15 grams. In many application cases it will be sufficient to adjust the axial pre-load of the braking band by an adjustment of the holder 9 in the axial direction. However, additionally it would be possible to provide a fine adjustment means, e.g. by rotating ring 8 in holder 9 in obliquely extending guiding grooves in which the Cardanic axis of the above-mentioned Cardanic holding engage. Furthermore, it could be expedient to select the geometric relative positions between the braking band holding device and the suspension ranges such that the braking band is pre-loaded against the braking band holding device prior to being pressed against the withdrawal rim 5 and that the braking band first will be set free from the braking holding device by the axial contact pressure against the withdrawal rim, as needed for the braking operation, and in order to achieve the necessary motion clearance for the self-centering and floating in relation to the withdrawal rim 5 and also the braking band carrier T. Such pre-tension would have the advantage of achieving a correct positioning of the braking band in the yarn brake in case of an adjustment of the yarn brake into a position in which the braking band is axially lifted from withdrawal rim 5, e.g. for threading up.

FIGS. 16 to 18 indicate easily mountable braking band holding means H. In FIG. 16 the braking band carrier is a circular membrane M made from elastomeric material. At the inner side a circumferentially extending pocket 38 is formed inside of an undulation 10. Said pocket 38 is limited by a preferably elastic lip 37 which grips around the outer edge of the braking band A. Instead of a circumferentially extending lip 37 discreet ear-shaped lip sections 37' could be provided defining several pockets 38' for inserting the braking band A, said pockets 38' being distributed around the circumference.

In FIGS. 17 and 18 several circumferentially distributed, arc-shaped slits 40 are provided in the substantially frusto-conical membrane M forming the braking band carrier T. Each slit 40 is defining an ear 39 which grips over the outer edge of the braking band as soon as the braking band is mounted. Lip 37 or sections 37' or ears 39 of FIGS. 16 to 18 may lie with elastic pressure on braking band A. The dimension of the lip 37, 37' or of the ears 39 preferably is predetermined such that under stresses in the braking band carrier T depending on the operation or during the operational movements of the braking band A the outer edge of braking band A is unable to come free. It suffices to have three sections 37' or ears 39 regularly distributed along the circumference of braking band A. For safety reasons, however, a larger number can be provided.

Although particular preferred embodiments of the invention have been disclosed in detail for illustrative purposes, it will be recognized that variations or modifications of the disclosed apparatus, including the rearrangement of parts, lie within the scope of the present invention.

What is claimed is:

1. A yarn feeding device including a storage body defining an axis and a circumferentially continuous withdrawal rim disposed in surrounding relation with the axis, a yarn brake including a frusto-conical, circumferentially continuous braking band oriented substantially coaxially relative to said storage body and which together with said withdrawal rim defines a yarn braking zone, said braking band being elastically deformable in a direction substantially perpendicular to a generatrix thereof, and a braking band carrier disposed in mechanical engaging relation with said braking band to press said braking band in the axial direction against said withdrawal rim during operation of said yarn brake, said carrier loosely supporting said braking band to allow same to float relative to both said withdrawal rim and said carrier.

2. The yarn feeding device of claim 1 wherein said carrier supports said braking band such that same is movable circumferentially about the axis relative to said withdrawal rim and said carrier.

3. The yarn feeding device of claim 2 wherein said carrier supports said braking band such that same is movable in a direction parallel to the generatrix thereof.

4. The yarn feeding device of claim 3 wherein said carrier supports said braking band such that same is tiltable in tangential directions relative to said withdrawal rim.

5. The yarn feeding device of claim 1 wherein said carrier is configured for loosely gripping with a clearance at least one of an outer and an inner annular edge of said braking band.

6. The yarn feeding device of claim 5 wherein said carrier comprises a circumferentially continuous ring constructed of plastic or metal, said ring defining an inwardly facing annular groove, and an annular coil spring disposed within said groove, said spring including a plurality of circumferentially-spaced spring windings which engage said braking band.

7. The yarn feeding device of claim 6 wherein said spring windings are oriented obliquely relative to an axis of said spring.

8. The yarn feeding device of claim 7 wherein said ring defines an inwardly opening annular channel in which said outer edge of said braking band is loosely engaged.

9. The yarn feeding device of claim 7 wherein said ring is configured to loosely engage both said inner and outer edges of said braking band.

10. The yarn feeding device of claim 5 wherein said carrier comprises a circumferentially continuous, frusto-conical annular and elastomeric membrane including least one undulation therein in which said outer edge of said braking band is loosely engaged.

11. The yarn feeding device of claim 5 wherein said carrier comprises an elastomeric and deformable ring-like member engaged with said braking band and defining an annular chamber containing a fluid, and said carrier loosely engaging said outer edge of said braking band.

12. The yarn feeding device of claim 5 wherein said carrier comprises a frusto-conical outer ring fixed to a support disposed adjacent said storage body, and a frusto-conical inner ring fixed to an inner surface of said outer ring and disposed to press said braking band against said withdrawal rim, said inner ring being constructed of an elastomeric material, and said carrier defining a pocket in which said outer edge of said braking band is loosely engaged.

13. The yarn feeding device of claim 12 wherein said inner ring defines an inwardly facing frusto-conical surface which engages an outer surface of said braking band, said surface having a profile which when viewed in the axial direction is one of a) circumferentially continuous and smooth and b) undulating so as to define a plurality of recesses and projections disposed in an alternating manner about a circumference of said braking band.

14. The yarn feeding device of claim 5 wherein said carrier comprises an annular and frusto-conical membrane constructed of elastomeric material and defining one of a) a circumferentially continuous pocket which opens inwardly and in which said outer edge of said braking band is loosely engaged and b) a plurality of ear-shaped lips disposed in circumferentially-spaced relation with one another, each said lip defining an inwardly-opening pocket in which said outer edge of said braking band is loosely engaged.

15. The yarn feeding device of claim 5 wherein said carrier comprises an annular and frusto-conical membrane constructed of elastomeric material and including a plurality of arc-shaped slits each of which defines an ear which loosely engages said outer edge of said braking band.

16. The yarn feeding device of claim 1 wherein said carrier directly contacts said braking band and presses same in the axial direction against said withdrawal rim.

17. The yarn feeding device of claim 1 wherein said carrier is resilient at least in the axial direction and is mounted on a support associated with said storage body, said support being axially adjustable relative to said withdrawal rim to adjust the axial load applied to said braking band.

18. The yarn feeding device of claim 1 wherein a wear element is positioned loosely between said carrier and said braking band, said wear element comprising a thin-walled, deformable, frusto-conical member disposed in surrounding relation with said braking band.

19. A yarn feeding device including a storage body defining an axis and a circumferentially continuous withdrawal rim disposed in surrounding relation with the axis, a yarn brake including a frusto-conical, circumferentially continuous braking band oriented substantially coaxially relative to said storage body and which together with said withdrawal rim defines a yarn braking zone, said braking band being elastically deformable in a direction substantially perpendicular to a generatrix thereof, and a braking band carrier disposed to press said braking band in the axial direction against said withdrawal rim, said carrier loosely supporting said braking band to allow same to float relative to both said withdrawal rim and said carrier, said carrier defining a plurality of circumferentially-spaced pressure elements, the respective pressure elements applying alternatingly stronger and weaker pressing forces to said braking band along a circumference thereof.

20. The yarn feeding device of claim 19 wherein said pressure elements are constructed of a resilient material.

21. The yarn feeding device of claim 19 wherein each of said pressure elements extends radially inwardly and terminates in an inner free end which engages said braking band.

22. A yarn feeding device including a storage body defining an axis and a circumferentially continuous withdrawal rim disposed in surrounding relation with the axis, a yarn brake including a frusto-conical, circumferentially continuous braking band oriented substantially coaxially relative to said storage body and which together with said withdrawal rim defines a yarn braking zone, said braking band being elastically deformable in a direction substantially perpendicular to a generatrix thereof, and a braking band carrier disposed to press said braking band in the axial direction against said withdrawal rim, said carrier loosely supporting said braking band to allow same to float relative to both said withdrawal rim and said carrier, said carrier being mounted on a stationary support disposed adjacent said storage body and said carrier being axially loaded by a spring assembly adjustably mounted on said support.

23. The yarn feeding device of claim 22 wherein said carrier comprises an axially rigid, radially deformable, thin-walled and frusto-conical member, said frusto-conical member defining a plurality of circumferentially distributed holding elements which loosely engage said inner edge of said braking band, said frusto-conical member being attached to said support at a small diameter end thereof, and said support defining a centrally-located yarn withdrawal eyelet.

24. A yarn feeding device including a storage body defining an axis and a circumferentially continuous withdrawal rim disposed in surrounding relation with the axis, a yarn brake including a frusto-conical, circumferentially continuous braking band oriented substantially coaxially relative to said storage body and which together with said withdrawal rim defines a yarn braking zone, said braking band being elastically deformable in a direction substantially perpendicular to a generatrix thereof, and a braking band carrier disposed to press said braking band in the axial direction against said withdrawal rim, said carrier loosely supporting said braking band to allow same to float relative to both said withdrawal rim and said carrier, said carrier being configured for loosely gripping with a clearance at least one of an outer and an inner annular edge of said braking band, and said carrier defining a plurality of circumferentially-spaced resilient pressure elements which project radially inwardly toward the axis and terminate in respective inner free ends which engage said braking band, said pressure elements respectively comprising spokes, spring-like lamellas or pins constructed of plastic or metal.

25. The yarn feeding device of claim 24 wherein said carrier includes an outer ring mounted in a support disposed adjacent said storage body and a holder disposed adjacent said outer ring, said pressure elements having outer ends connected to said outer ring, said pressure elements being oriented at a common oblique angle relative to the axis, and said holder along with inner sides of the respective pressure elements defining an annular pocket in which said outer edge of said braking band is loosely engaged.

26. A yarn brake for a yarn feeding device, said brake including a circumferentially continuous, annular and frusto-conical braking band which is deformable in a direction substantially perpendicular to a generatrix thereof, and a carrier disposed in mechanical engaging relation with said braking band to hold said braking band in a braking position against a withdrawal rim of a storage body during operation of said yarn brake, said carrier mounting said braking band thereon in a non-fixed and loose manner to allow said braking band to freely float relative to said carrier and the withdrawal rim.

27. The yarn brake of claim 26 wherein said carrier mounts said braking band such that same is both circumferentially movable along the withdrawal rim relative to said carrier and movable in a direction parallel to the generatrix.

28. A yarn brake for a yarn feeding device, said brake including a circumferentially continuous, annular and frusto-conical braking band which is deformable in a direction substantially perpendicular to a generatrix thereof, and a carrier disposed to hold said braking band in a braking position against a withdrawal rim of a storage body, said carrier mounting said braking band thereon in a non-fixed and loose manner to allow said braking band to freely float relative to said carrier and the withdrawal rim and so that said braking band is both circumferentially movable along the withdrawal rim relative to said carrier and movable in a direction parallel to the generatrix, said carrier including a plurality of radially inwardly extending and circumferentially-spaced resilient arms which terminate in respective inner free ends which engage said braking band.

29. The yarn brake of claim 27 wherein said carrier is configured for loosely engaging at least one of an outer and inner annular edge of said braking band to prevent same from separating from said carrier, and said carrier contacts said braking band to hold same in the braking position against the storage body.

* * * * *